US008814004B2

(12) United States Patent
Letica et al.

(10) Patent No.: US 8,814,004 B2
(45) Date of Patent: Aug. 26, 2014

(54) TAMPER EVIDENT PULL-OUT SPOUT

(75) Inventors: Anton Letica, Bloomfield Hills, MI (US); Randall J. Corbett, Macomb, MI (US); John R. Selina, Brighton, MI (US)

(73) Assignee: Letica Corporation, Rochester, MI (US)

( * ) Notice: Subject to any disclaimer, the term of this patent is extended or adjusted under 35 U.S.C. 154(b) by 94 days.

(21) Appl. No.: 13/609,697

(22) Filed: Sep. 11, 2012

(65) Prior Publication Data

US 2014/0069955 A1 Mar. 13, 2014

(51) Int. Cl.
*B67B 1/00* (2006.01)

(52) U.S. Cl.
USPC ..... 222/153.14; 222/153.06; 222/153.07; 222/529; 222/530; 222/541.9

(58) Field of Classification Search
CPC ..... B65D 25/44; B65D 25/46; B65D 25/48; B65D 47/06
USPC ..... 222/153.01, 153.14, 153.05, 153.06, 222/153.07, 529–531, 541.5, 541.9; 220/258.2–258.3, 269–270; 215/215, 215/255–257
See application file for complete search history.

(56) References Cited

U.S. PATENT DOCUMENTS

| | | | | | |
|---|---|---|---|---|---|
| 3,515,966 | A | * | 6/1970 | Lavet Marius et al. | 318/127 |
| 4,422,563 | A | * | 12/1983 | Babiol | 222/153.09 |
| 4,568,006 | A | * | 2/1986 | Mueller et al. | 222/488 |
| 4,618,078 | A | | 10/1986 | Hamman et al. | |
| 4,632,282 | A | * | 12/1986 | Nagashima | 222/529 |
| 5,004,126 | A | * | 4/1991 | Klesius | 222/153.09 |
| 5,566,864 | A | * | 10/1996 | Stolz | 222/153.14 |
| 5,577,643 | A | * | 11/1996 | Stolz | 222/529 |
| 5,641,099 | A | | 6/1997 | McLelland et al. | |
| 5,788,100 | A | * | 8/1998 | Sturk | 215/258 |
| 5,797,525 | A | | 8/1998 | McLelland et al. | |
| 5,884,815 | A | * | 3/1999 | Stolz | 222/153.14 |
| 5,899,364 | A | * | 5/1999 | McLelland et al. | 222/153.06 |
| 5,941,425 | A | * | 8/1999 | Stolz | 222/153.14 |
| 6,237,818 | B1 | | 5/2001 | Kline | |
| 7,614,530 | B2 | | 11/2009 | Baughman et al. | |
| 7,717,307 | B2 | | 5/2010 | Baughman et al. | |
| 7,798,378 | B2 | | 9/2010 | Baughman et al. | |
| 2007/0284398 | A1 | | 12/2007 | Baughman et al. | |

* cited by examiner

*Primary Examiner* — Frederick C Nicolas
(74) *Attorney, Agent, or Firm* — Young Basile Hanlon & MacFarlane PC

(57) ABSTRACT

A tamper evident, pull-out flexible spout for use in combination with a container lid wherein a cap can only be removed from the threaded end of the spout by lifting a pair of bail rings which are attached to the cap by way of a set of frangible connectors and thereafter pulling the spout out from the stored position at least part way toward the use position thereby to disengage lugs on an exterior surface of the cap from a pair of one-way stops on an interior surface of the spout ring.

7 Claims, 5 Drawing Sheets

TAMPER EVIDENT PULL-OUT SPOUT

FIELD OF THE INVENTION

The invention relates to pull-out spouts for containers of the type having lids and more particularly to a pull-out spout having a cap that can only be removed after the spout has been at least partially pulled out from a stored position.

BACKGROUND OF THE INVENTION

It is often desirable to provide a pouring spout in a lid for an industrial container for pourable materials such as liquids and particulates. Common features of such spouts are a soft plastic tube that can be folded into an annular rim structure for storage and extended for pouring, and a screw-on cap with bails that are normally held in a flat position.

SUMMARY OF THE INVENTION

The present invention provides an improved pull-out spout generally of the type described above but having a further feature that prevents rotation of the cap in the removal direction unless and until the spout is at least partially extended from the stored position. In general, this feature comprises one or more one-way stops concentrically formed on an interior surface of a flanged spout body and one or more lugs formed on an exterior surface of the cap and dimensioned so as to provide interference with the one-way stops whenever an attempt is made to rotate the cap in the removal or "off" direction while the spout is in the fully inverted condition. The lugs and stops are disengaged by extending the spout at least partially. The one-way stops allow the cap to be rotated in the on direction whether or not the spout is extended. The lugs accommodate the use of mechanized equipment to install the cap on the spout.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
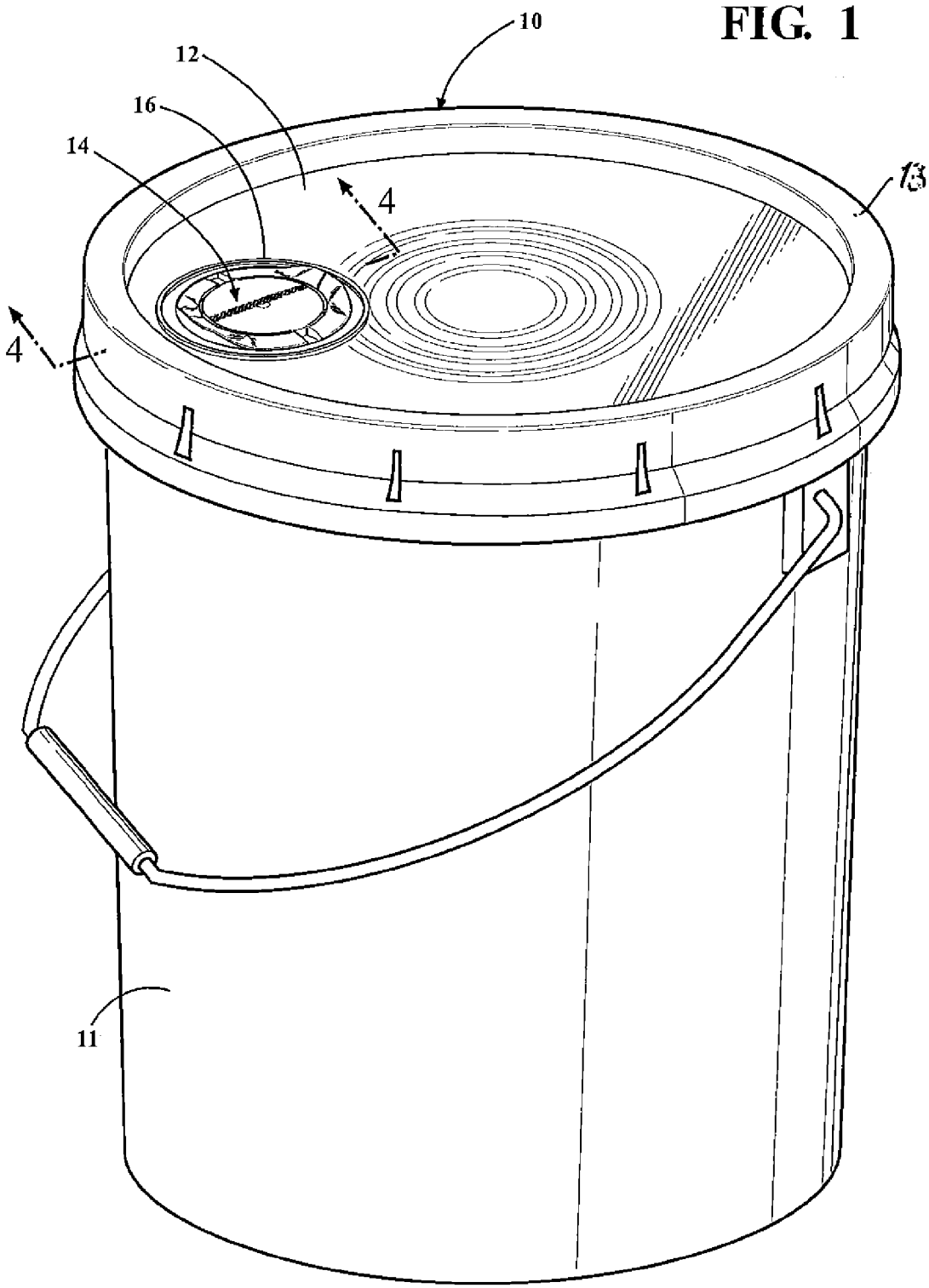
FIG. 1 is a perspective view of a container assembly with a spout constructed in accordance with the present invention.

FIG. 1 shows in perspective a molded high density polyethylene (HDPE) 6-gallon container 11 having a lock-on lid

10. The HDPE lid 10 comprises a deck 12 surrounded by a peripheral rim structure with an inverted U-shaped channel (not shown) adapted to receive and lock onto the top rim 13 of the HDPE container 11. A spout assembly 14 is shown mounted within a circular opening which has been preformed in the deck 12 of the lid 10. Several concentric annular rings 16 are molded around the opening to provide structural strength to this part of the deck.

Figure 2:
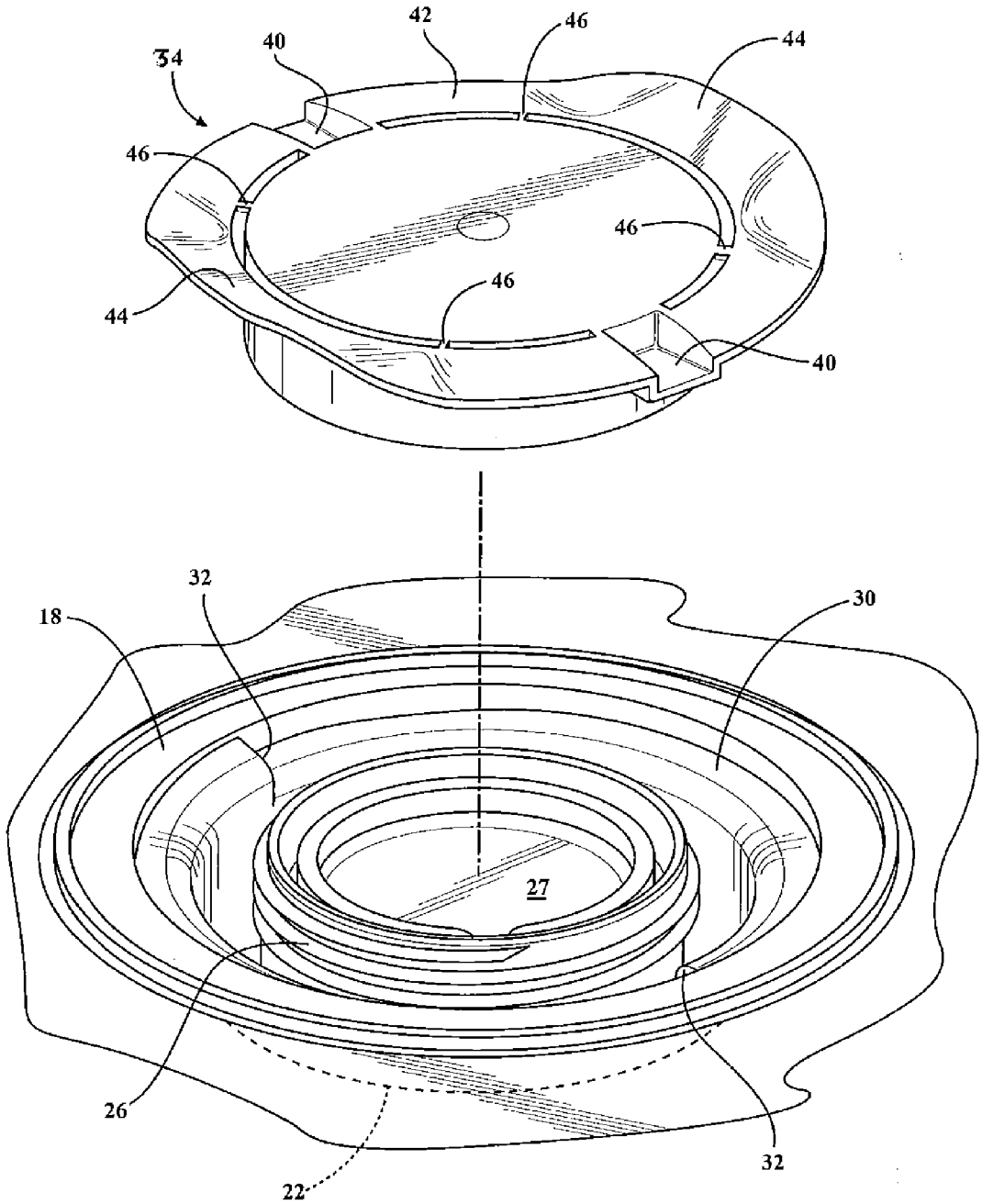
FIG. 2 is an exploded perspective view of the spout in FIG. 1 with the cap removed.
Figure 3:
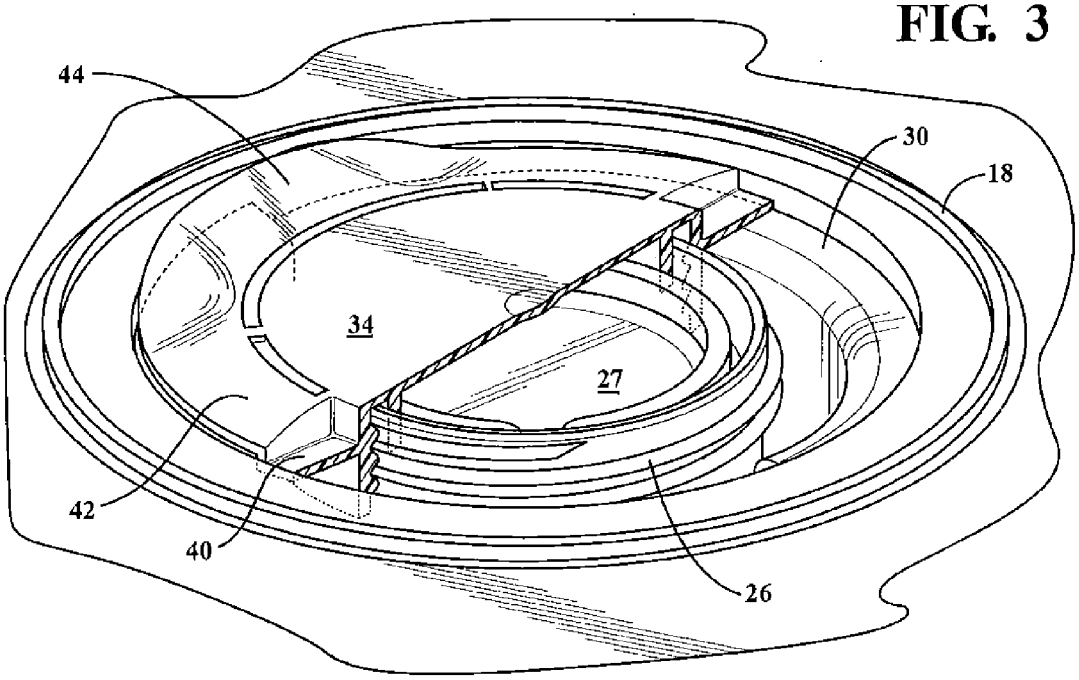
FIG. 3 is a perspective view of the spout in the inverted condition, showing the cap in section.
Figure 4:
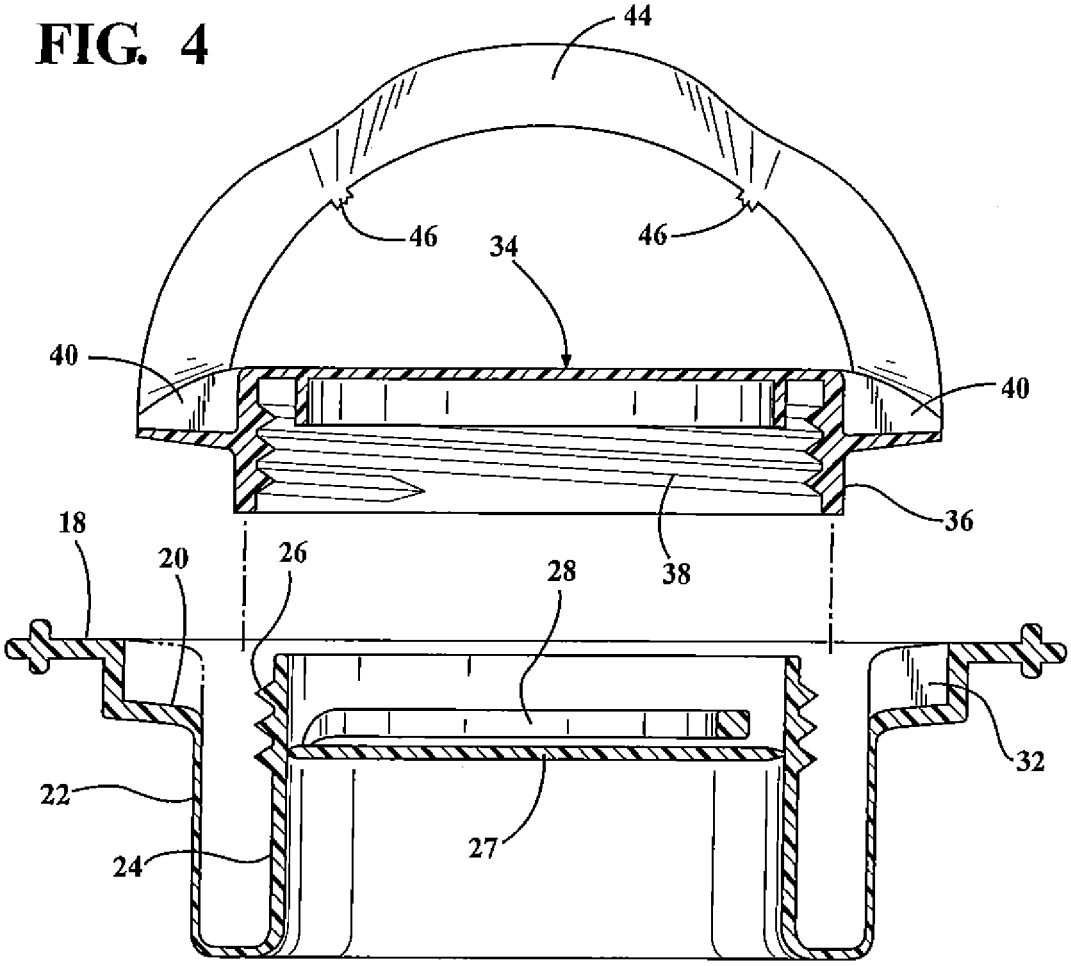
FIG. 4 is a sectional exploded view of the cap and inverted spout.
Figure 6:
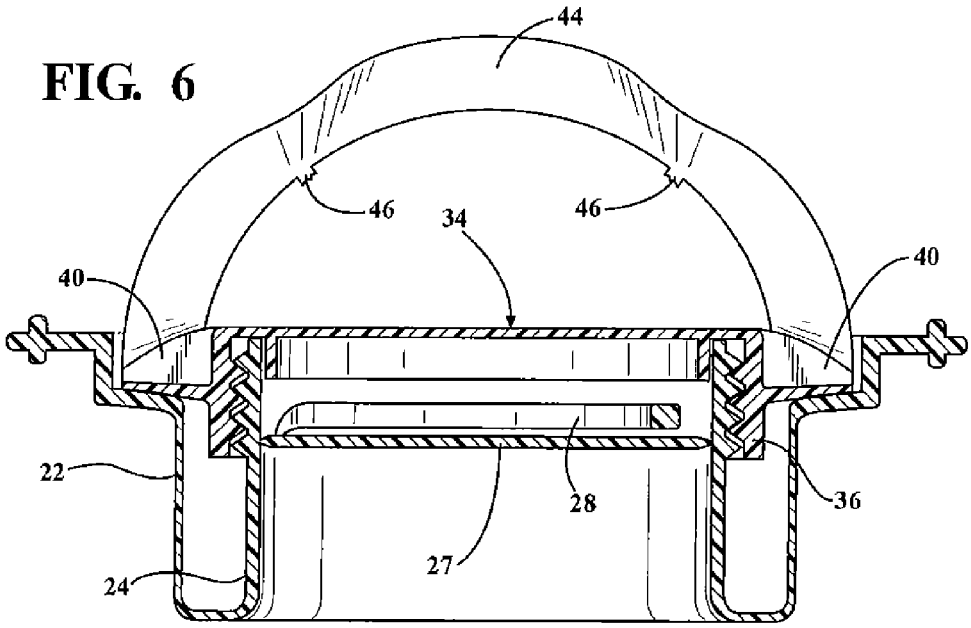
FIG. 6 is a side sectional view of the spout with a bail ring raised.
Figure 7:
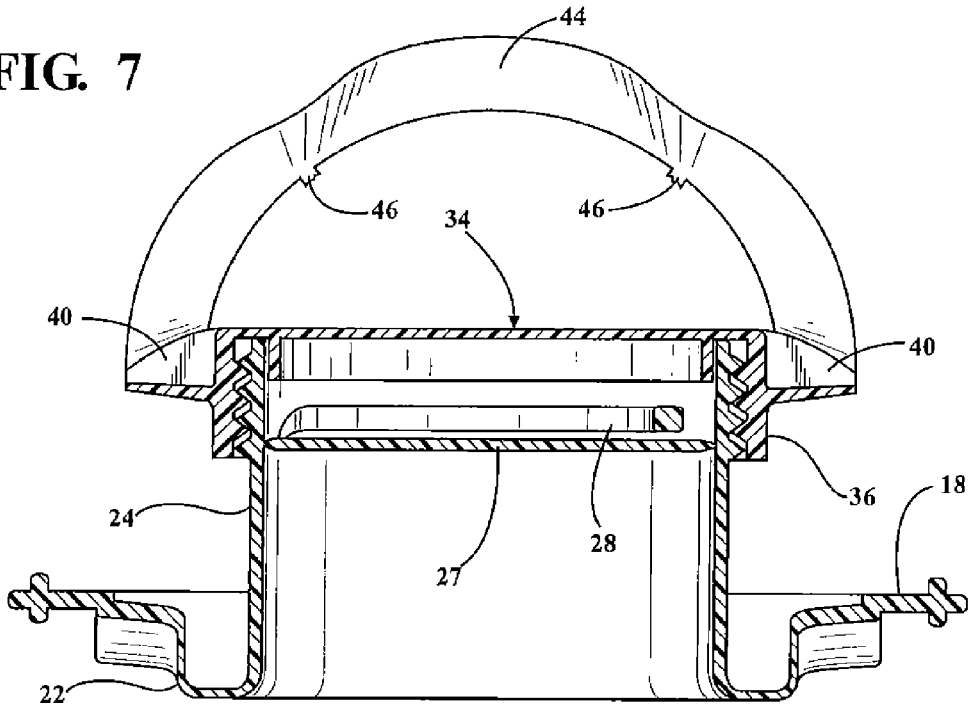
FIG. 7 is a side sectional view of the spout in a substantially extended condition.

Looking now to FIGS. 2-5, details of the spout assembly 14 will be described. As shown, the spout assembly comprises a relatively stiff peripheral flange ring 18, a tubular body 22 and a cap 34. The flange ring 18 is designed to fit into the opening in the deck of the lid 10 in the manner shown in FIG. 1. The ring may be secured to the deck in any of several different ways including adhesive bonding, a snap-fit, and/or welding, either spin welding, ultrasonic welding or other types which heat and fuse the materials of the flange ring 18 and the lid 10. The flange ring 18 is molded integral with a flexible tubular portion 22, sometimes referred to as a "sock", which is designed to occupy an inverted or stored position as shown in FIGS. 2 and 4 wherein virtually the entire spout is nested down concentrically within the flange ring 18. The spout tube 22 can be pulled out to an extended position as shown in FIG. 7 wherein the spout is fully unrolled and/or extended upwardly from the flange ring 18 and the lid deck 12 to aid in dispensing the contents of the container to which the lid 10 and spout assembly 14 is attached. Threads 26 are formed on the outer end surface of the spout neck 24. As shown in FIG. 4, the neck 24 is thicker and stiffer than the invertible sock body 22. A conventional tear-away membrane seal 27 may be integrally formed within the spout neck 24 and has its own pull ring 28 so that it may be easily torn out and discarded when it is time to dispense material from the container onto which the lid 10 and spout assembly 17 are attached.

As shown in FIGS. 2-6, the flange ring 18 has an interior step 20 that provides two gradually descending annular ramps 30 separated by abrupt vertical surfaces forming stops 32 around the inside surface of the ring 18 to function in a manner hereinafter described in connection with lugs 40 which are formed as part of a threaded-on plastic cap 34.

Describing now the cap 34, a closed cylindrical plastic cap is provided with interior threads 38 which mate with the threads 26 on the spout neck 24, thus allowing the cap 34 to be screwed onto and off of the spout neck 24 by means of conventional rotation directions of the cap relative to the spout. Surrounding the cap body are integral semi-circular bail rings 42 which are molded flat and generally flush with the top of the cap. Each ring has a bent-up edge 44 in the center. The opposite ends of the semi-circular bail rings 42 are integrally connected to the side wall of the cylindrical cap 34 by rectangular depressed lugs 40, also aptly described as locking channels, which cooperate with the ramps 30 and stops 32 of the spout assembly as hereinafter described. While the lugs 40 provide permanent points of attachment between the bail rings 42 and the cap body 36, semi-permanent attachments are also provided by small frangible sections 46 at four points, two on each of the bail rings 42. These frangible sections can be broken by lifting the bail rings 40 from the essentially flush condition shown in FIGS. 2 and 3 to a raised position shown in FIG. 4 where they can be used not only to pull the spout 24 out from the inverted or nested position shown in FIG. 2 toward the extended position shown in FIG. 7 but also used to turn the cap 34 on the spout neck 24. The breaking of the frangible sections 46 provides a tamper evident feature.

Figure 5:
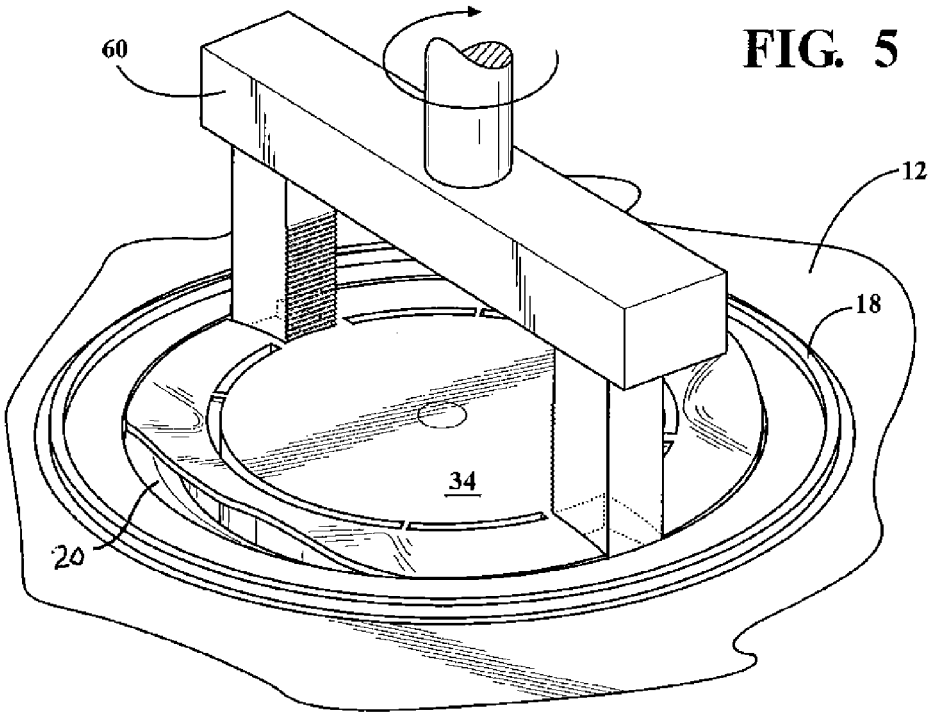
FIG. 5 is a perspective view of the spout assembly while the cap is being installed.

As shown in FIG. 5, the cap 34 is normally installed on the spout assembly by automated machinery including a tool 60 which extends into the cap lock channels 40 to rotate the cap in the clockwise direction which is the conventional direction for "making" the threaded connection in the United States. This procedure is normally carried out with the spout fully inverted as shown in FIG. 2. In this condition, the bottom surfaces of the lugs 40 ride along the tops of the ramps 30 without interference and snap down over the one-way stops 32. This action permits as many rotations as are necessary to fully install the cap 34 on the spout assembly until the cap is fully engaged and the lugs 40 are fully seated against the bottoms of the ramps 30 as shown in FIG. 9.

To release the cap 34 from the spout assembly, it is first necessary to raise the bail rings 40, this move being facilitated by the bent-up ring edges 44 until the frangible sections 46 are broken, thus providing the first of two tamper evident features. An attempt at this point to rotate the cap 34 relative to the spout assembly will be defeated by interference between the cap lugs 40 and the stops 32 on the interior surface of the spout ring. However, by pulling upwardly on the cap 34 and the spout so as to unfold and extend the spout neck 24 as shown in FIG. 7, the lugs 40 are pulled above the stops 32 thus allowing the cap to be rotated in the counter-clockwise direction which is the conventional direction used for unthreading a threaded connection in the United States. As will be appreciated, a second tamper evident function is provided by the tear-away membrane 27, 28 on the inside of the threaded portion of the spout neck 34. The cap may be reinstalled manually with the spout extended or inverted. The spout neck 22 is tough enough to withstand numerous inversions and extensions.

Summarizing, there are two motions which are required to move a fully and properly seated and locked cap assembly 34 from the spout assembly. First, the bail rings 42 must be raised, thus breaking the frangible connectors 46 and providing the first of the two tamper evident features. The raised bail rings are then used to pull the spout neck 22 from the nested or inverted condition shown in FIG. 2 to the raised or extended position. At this point, the cap 34 may be rotated in the counter-clockwise direction without interference provided by the elements 40, 42 so as to remove the cap 34 from the spout. Finally, if the cap is being removed for the first time, the membrane 47 must be removed by pulling on the ring 28 thus providing the second of the two tamper evident features.

As will be apparent to those skilled in the art, the entire assembly including the lid, spout and cap area all injection molded using polyethylene as the preferred material, albeit other polymers and blends of polymers may also be used.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A tamper evident, pull-out spout for a container having a lid comprising:

a flanged annular body adapted to be attached to an opening in a lid;

a flexible spout integral with the body and being foldable concentrically into the body to provide a storage position but extendable outwardly from the body for use;

a cap threadably engagable with the spout for closing same and rotatable in opposite on and off directions;

at least one bail integrally attached to the cap in surrounding relation and being further attached to the cap by at least one frangible section which must be broken to raise the bail to a use position; and means for preventing rotation of the cap relative to the spout in the off direction whenever the spout is in the stored position, said means comprising at least one one-way stop formed on an interior surface of the annular body and at least one lug formed on an outside surface of the cap and dimensioned to cooperate with the one-way stop on the body to permit rotation in the on direction but to prevent rotation in the off direction whenever the spout is in the stored position but permit rotation of the cap in both directions whenever the spout is extended at least partly to the use position.

2. A spout as defined in claim 1 wherein the cap is provided with two symmetrically arranged, semi-circular bails and the cap has two diametrically opposed lugs formed on said outer surface.

3. The spout as defined in claim 1 wherein the spout body and cap are molded plastic components.

4. The spout as defined in claim 1 further including a removable membrane seal disposed within the interior of the spout and having an integral pull ring for forcible removal thereof.

5. An extendible plastic spout for use in combination with a closure for a container comprising:

an externally threaded, generally cylindrical neck portion;

a flexible spout portion integral with the neck portion and coaxial therewith and extending radially outwardly into an integral cylindrical surround that is concentric with the neck portion and progressively invertible by outward pull on the neck portion, said surround having at least one radial shoulder having a circumferential stop;

a cap having a top surface and being threadedly engaged with the threaded neck portion for rotation relative thereto, said cap having at least one circular pull ring molded in a flush condition with the top surface, said pull ring being joined to the cap by at least one frangible anchor section and at least two non-frangible anchor sections;

said cap having at least one radially extending lug that, when the cap is threaded onto the neck portion, abuts said shoulder to prevent rotation of the cap in the off direction when the neck portion is fully recessed into the surround, whereby, removal of the cap requires breaking said frangible anchor section by raising said pull ring from the flush condition, pulling the neck portion outwardly to clear the abutting relationship between the lug and shoulder, and rotating the cap after clearing said abutted relationship.

6. An extendible plastic spout as defined in claim 5 wherein the cap has two diametrically opposite lugs and the surround defines two diametrically opposite shoulders acting as stops for respective lugs, the cap further having two semi-circular pull rings, each molded flush with the top of the cap.

7. An extendible plastic spout as defined in claim 6 further comprising a closure joined by integral molding to the spout surround.

* * * * *